US010131413B2

(12) United States Patent
Celentano

(10) Patent No.: US 10,131,413 B2
(45) Date of Patent: Nov. 20, 2018

(54) MARINE PROPULSION UNIT HAVING A ROTATING CYLINDER DRIVING AN IMPELLER

(71) Applicant: Michael Anthony Celentano, Hudson, FL (US)

(72) Inventor: Michael Anthony Celentano, Hudson, FL (US)

( * ) Notice: Subject to any disclaimer, the term of this patent is extended or adjusted under 35 U.S.C. 154(b) by 421 days.

(21) Appl. No.: 14/960,735

(22) Filed: Dec. 7, 2015

(65) Prior Publication Data

US 2017/0158300 A1 Jun. 8, 2017

(51) Int. Cl.

| | |
|---|---|
| ***B63H 11/02*** | (2006.01) |
| ***B63H 25/46*** | (2006.01) |
| ***B63H 23/24*** | (2006.01) |
| ***B63H 21/17*** | (2006.01) |
| *B63H 1/12* | (2006.01) |
| *B63H 1/16* | (2006.01) |

(52) U.S. Cl.

CPC ..... *B63H 11/02* (2013.01); *B63H 21/17* (2013.01); *B63H 23/24* (2013.01); *B63H 25/46* (2013.01); *B63H 2001/127* (2013.01); *B63H 2001/165* (2013.01); *B63H 2025/465* (2013.01)

(58) Field of Classification Search

CPC ..... B63H 11/00; B63H 11/02; B63H 21/12; B63H 21/17; B63H 23/24; B63H 25/46

USPC ..... 440/5, 6; 310/114

See application file for complete search history.

(56) References Cited

U.S. PATENT DOCUMENTS

| | | | | | |
|---|---|---|---|---|---|
| 3,914,629 | A * | 10/1975 | Gardiner | H02K 5/132 | 440/6 |
| 5,185,545 | A * | 2/1993 | Veronesi | B63H 21/17 | 440/6 |
| 5,306,183 | A * | 4/1994 | Holt | B63H 23/24 | 440/6 |
| 5,722,864 | A * | 3/1998 | Andiarena | B63H 11/08 | 440/5 |
| 7,238,066 | B2 * | 7/2007 | Taylor | B63H 21/17 | 440/6 |

* cited by examiner

*Primary Examiner* — Lars A Olson

(74) *Attorney, Agent, or Firm* — Tiffany C. Miller; Inventions International Inc.

(57) ABSTRACT

A self-contained marine propulsion impeller system, whereby, the impeller is driven from an outer perimeter of a cylinder, thereby, creating thrust. The impeller is connected to an inner wall of the cylinder. The cylinder has a primary end located opposite a secondary end. The primary end of the cylinder has a primary sealing member and a primary bearing member. The secondary end of the cylinder has a secondary sealing member and a secondary bearing member. A plurality of magnets are connected to an outer perimeter wall of the cylinder. The plurality of magnets are located between the first bearing member and the second bearing member. The cylinder is surrounded by a housing. At least one coil winding is connected to an inner wall surface of the housing. The rotating cylinder is suspended within the housing by the first bearing member and the secondary bearing member.

2 Claims, 12 Drawing Sheets

MARINE PROPULSION UNIT HAVING A ROTATING CYLINDER DRIVING AN IMPELLER

BACKGROUND OF THE INVENTION

1. Field of the Invention

This invention relates, generally, to a marine propulsion unit. More particularly, it relates to a marine propulsion unit having a cylinder driving an impeller, thereby, creating thrust.

2. Background Art

Currently, many vessels including, but not limited to, submarines, recreational, commercial, or military use a bow thruster or a stern thruster assembly having a propeller connected to a gear train and the gear train is connected to a bulky external motor needing a large compartment to house the external motor and heavy drive assembly. Many vessels warrant the need for a bow thruster for safety and ease of operation, but they do not have the space to house the motor and drive assembly within a concealed compartment. For example, smaller single engine boats have limited space and warrant the need for a more compact and lighter weight assembly. Thus, there is a need for a bow thruster that does not have an external motor so that the assembly can easily fit within a vessel.

Prior art submarine propulsion assemblies use an external propeller at the stern of the vessel. These propulsion assemblies require bulky engines and motors that can consist of fuel sources and have complicated transmission systems including, but not limited to, drive shafts and gears. The integration of moving parts creates detectable vibrations and noise. Additionally, these moving parts require maintenance, trouble shooting, and repair. Thus, there is a need to have an electromagnetic propulsion system having only one moving assembly capable of being contained within a submarine. This is more desirable because the propulsion system is more quiet, more reliable, more efficient, and easier to maintain and repair. Further, by having only one moving assembly, the use of an engine or a motor is eliminated and the need for a transmission is eliminated, whereby lowering fuel consumption. Another result is the reduction of equipment casualties and maintenance shutdowns, thereby, improving operational readiness.

Conventional impeller driven vessels drive the impeller via a drive shaft centrally connected to an impeller. The drive shaft is an obstruction of the water flow through the impeller. Also, a spinning drive shaft is susceptible to entanglement of water born debris including, but not limited to, ropes, fishing line, or weeds. Therefore, there is a long felt but unfulfilled need for the impeller being connected to a cylinder, whereby, the cylinder is the rotating portion of a brushless motor.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a self-contained marine propulsion impeller system, whereby, the impeller is driven from an outer perimeter of a cylinder, thereby, creating thrust. The impeller is connected to an inner wall of the cylinder. It is within the scope of this invention for an impeller to include, but not be limited to, an auger, a propeller, an impeller, or any rotating device that can transfer liquid from one end of the cylinder to the opposite end of the cylinder. The cylinder has a primary end located opposite a secondary end. The primary end of the cylinder has a primary sealing member and a primary bearing member. The secondary end of the cylinder has a secondary sealing member and a secondary bearing member. It is within the scope of this invention for a bearing member to include, but not be limited to, a roller bearing or a needle bearing.

A plurality of magnets are connected to an outer perimeter wall of the cylinder. The plurality of magnets are located between the primary bearing member and the secondary bearing member. The cylinder is surrounded by a housing. At least one coil winding is connected to an inner wall surface of the housing. The rotating cylinder is suspended within the housing by the primary bearing member and the secondary bearing member which also includes improvements that overcome the limitations of prior art marine propulsion units is now met by a new, useful, and non-obvious invention.

The novel marine propulsion unit has a cylinder. The cylinder is substantially surrounding an impeller. The impeller is connected to the cylinder. The cylinder has a primary end located opposite a secondary end. The cylinder has a primary bearing member and a primary sealing member located on the primary end of the cylinder. The cylinder has a secondary bearing member and a secondary sealing member located on the secondary end of the cylinder. The sealing members create a water resistant seal to prevent water from entering between the cylinder and the housing. It is within the scope of this invention for an end of the cylinder to include, but not be limited to, the very end of the cylinder, not the very end of a cylinder, any area on the cylinder where the plurality of magnets can fit between both the bearing members and the sealing members, or a distance far enough apart so that the plurality of magnets can fit between both the bearing members and the sealing members.

The cylinder has a plurality of magnets connected to the cylinder. The plurality of magnets are located between the primary bearing member and the secondary bearing member. The cylinder is substantially surrounded by a housing. The housing is connected to at least one coil winding. The at least one coil winding is associated with an electrical power source, whereby, the combination of the at least one coil winding and the plurality of magnets form a motor causing the cylinder to rotate within the housing when the electrical power source is applied to the at least one coil winding.

In a preferred embodiment, at least one coil winding is electrically connected with an electronic speed control (ESC). The electronic speed control receives commands from including, but not limited to, a variable electronic device or a switch. It is within the scope of this invention for an variable electronic device to include, but not be limited to, a mechanical switch, circuitry, a gas pedal, a computer, a wireless computer, or a joystick connected to circuitry. It is within the scope of this invention for circuitry to include, but not be limited to, a potentiometer controlled by including but not limited to a person or by a computer.

In an alternate embodiment, a method of driving an impeller of a marine propulsion unit system has the steps of providing a vessel. Providing a novel marine propulsion unit connected to the vessel. The marine propulsion unit having a cylinder substantially surrounding an impeller. The impeller is connected to the cylinder. The cylinder has a primary end located opposite a secondary end. The cylinder has a primary bearing member and a primary sealing member located on the primary end of the cylinder. The cylinder has a secondary bearing member and a secondary sealing member located on the secondary end of the cylinder. The cylinder has a plurality of magnets connected to the cylinder. The plurality of magnets are located between the primary bearing member and the secondary bearing member. The cylinder is substantially surrounded by a housing. The housing is connected to at least one coil winding.

The method has a further step providing an electrical power source associated with at least one coil winding, whereby, the combination of the at least one coil winding and the plurality of magnets form a motor causing the cylinder to rotate within the housing when the electrical power source is applied to the at least one coil winding. Producing thrust in a first direction when a liquid is drawn into the primary end of the cylinder, whereby, orienting the vessel in a first orientation. Producing thrust in a second direction when the liquid is drawn into the secondary end of the cylinder, whereby, orienting the vessel in a secondary orientation.

In another embodiment, the method has a further step of providing an electronic speed control being electrically connected with at least one coil winding. The electronic speed control is receiving commands from a variable electronic device. In an alternate embodiment, the electronic speed control is receiving commands from a switch.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 3:
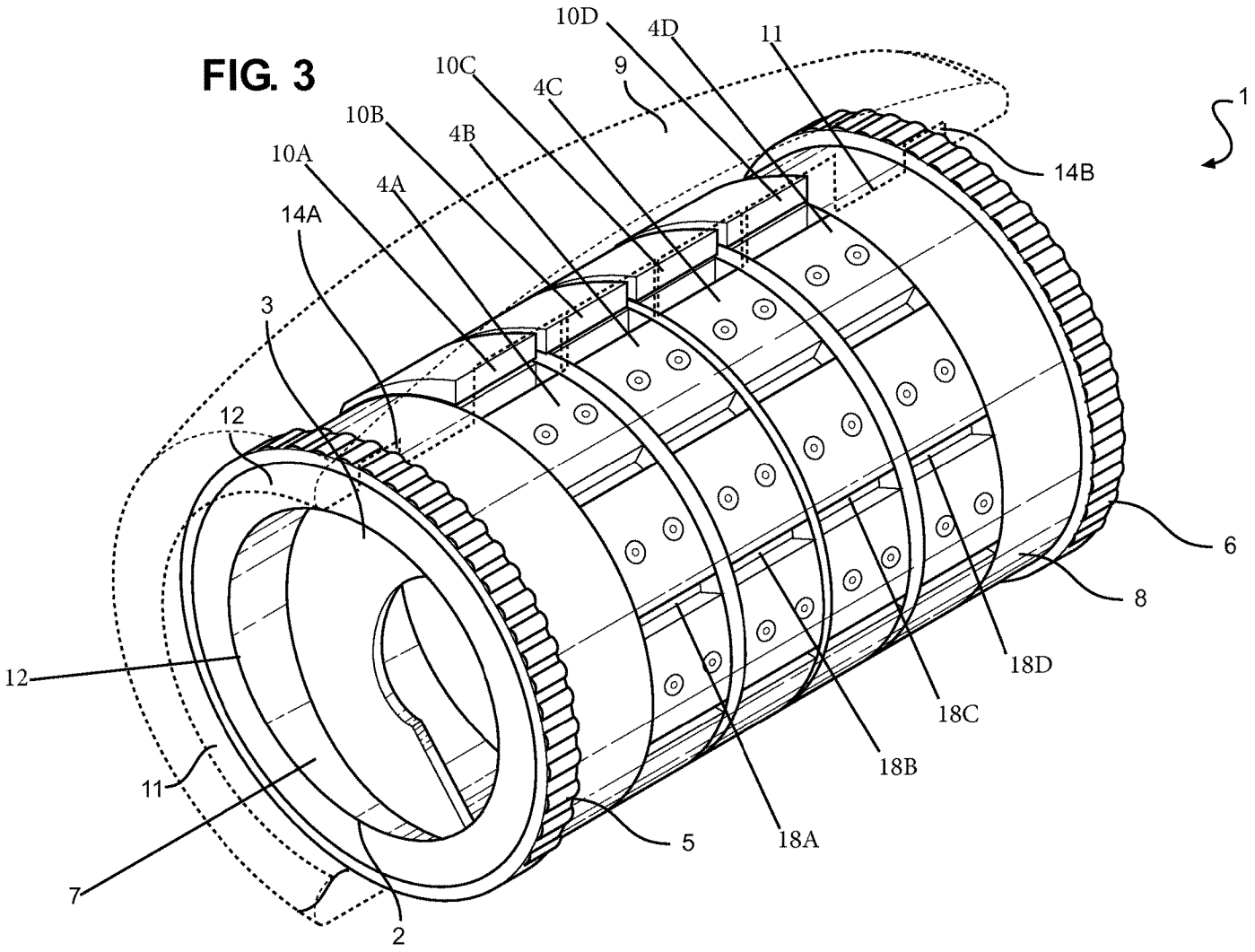
FIG. 3 is a perspective cut-away view of another embodiment of the novel marine propulsion unit having a cylinder substantially surrounded by a housing, the cylinder having a plurality of magnets being flush with the outer wall of the cylinder, the plurality of magnets are located between a primary bearing member and a secondary bearing member, and at least one coil winding is connected to an inner wall surface of the housing.
Figure 4:
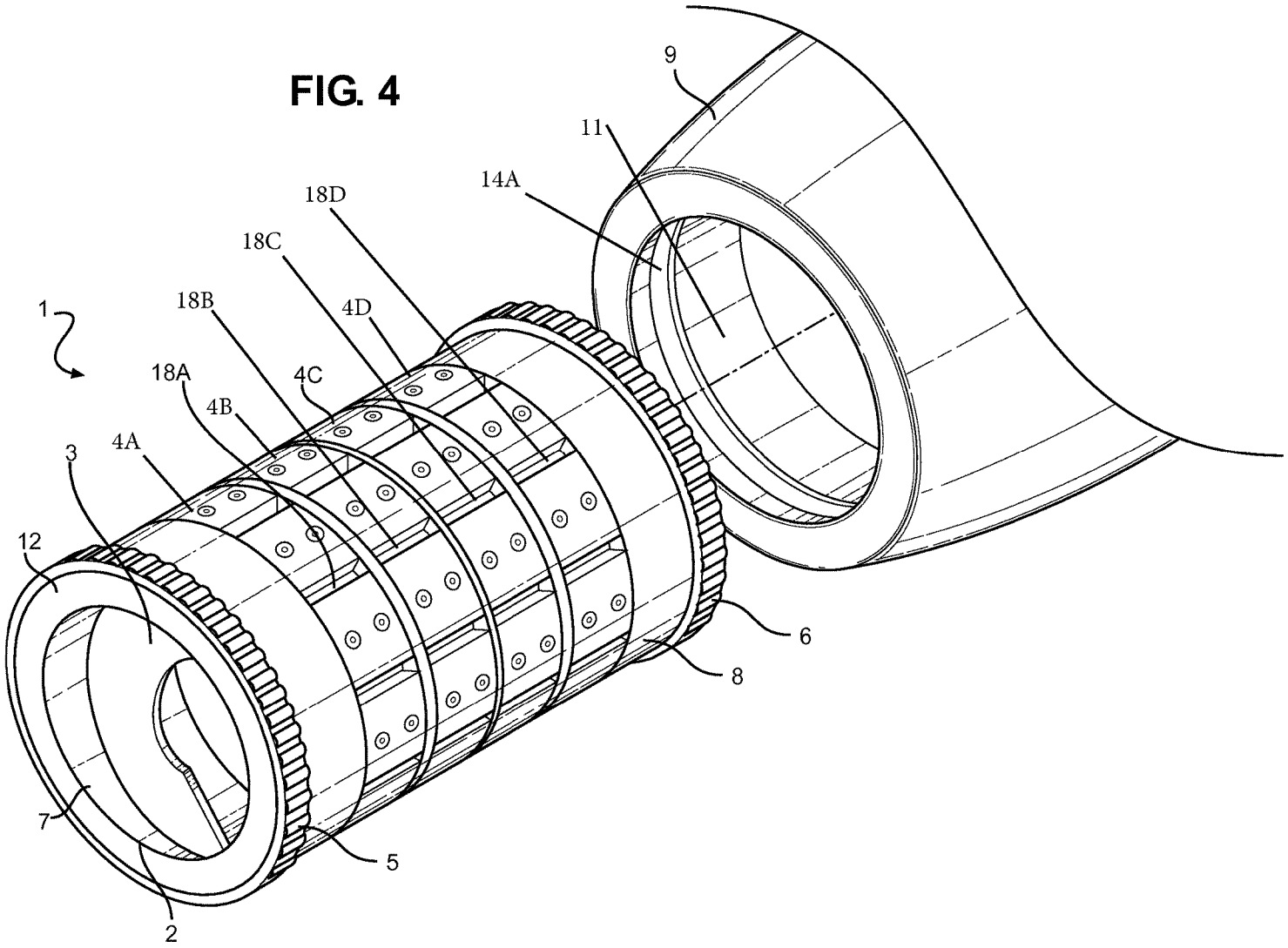
FIG. 4 is an exploded view of the novel cylinder substantially surrounding an impeller connected to the cylinder, the cylinder has a plurality of magnets being flush with the outer wall of the cylinder, the plurality of magnets are located between a primary bearing member and a secondary bearing member, and the cylinder is substantially surrounded by a housing, whereby, at least one coil winding is connected to an inner wall surface of the housing.
Figure 5:
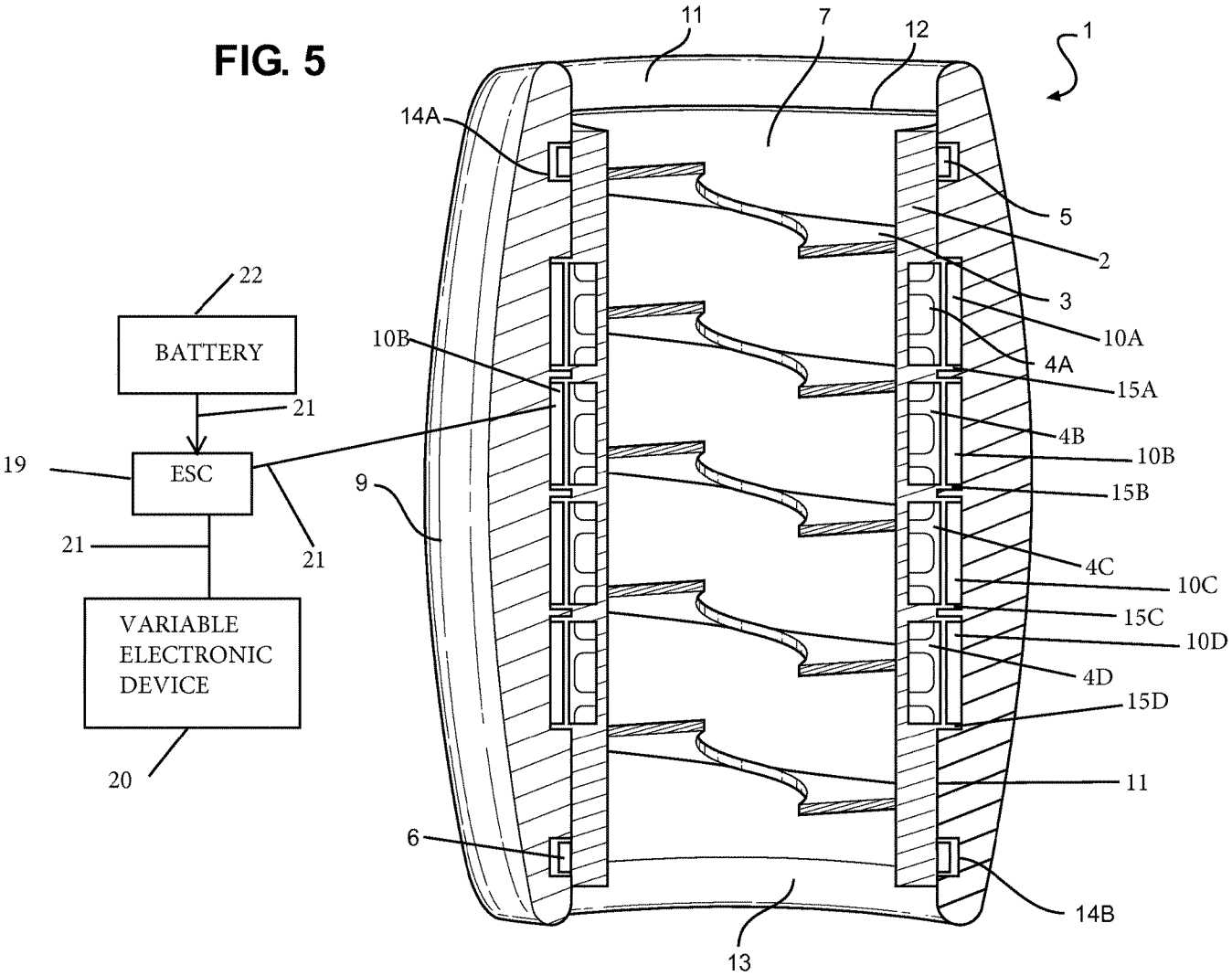
FIG. 5 is a side cut-away view of the novel marine propulsion unit having a cylinder substantially surrounded by a housing, the cylinder is substantially surrounding an impeller connected to the cylinder, the cylinder has a primary end located opposite a secondary end, the cylinder has a plurality of magnets being flush with the outer wall of the cylinder, the plurality of magnets are located between a primary bearing member and a secondary bearing member, at least one coil winding is connected to an inner wall surface of the housing, the at least one coil winging is in electrical connection with an ESC.
Figure 6:
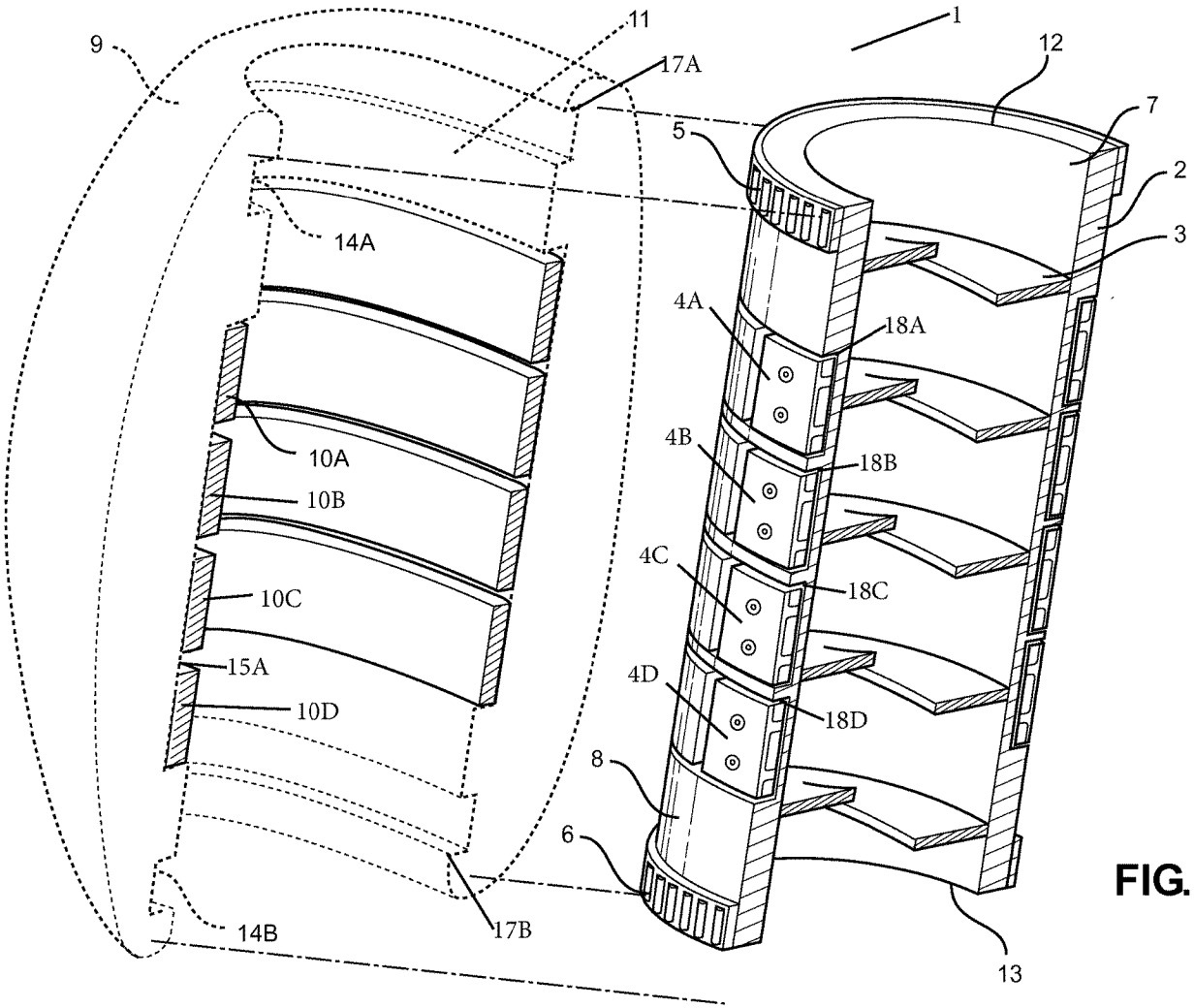
FIG. 6 is an exploded cut-away view of the novel cylinder substantially surrounding an impeller connected to the cylinder, the cylinder has a plurality of magnets being flush with the outer wall of the cylinder, the plurality of magnets are located between a primary bearing member and a secondary bearing member, and the cylinder is substantially surrounded by a housing, whereby, at least one coil winding is connected to an inner wall surface of the housing.

It will now be seen, referring to FIGS. 1-6, marine propulsion unit 1 has cylinder 2 substantially surrounding impeller 3. Impeller 3 is connected to inner wall 7 of cylinder 2. Cylinder 2 has primary end 12 located opposite secondary end 13 (FIGS. 5 and 6). Cylinder 2 is substantially surrounded by housing 9 having inner wall 11.

Figure 2:
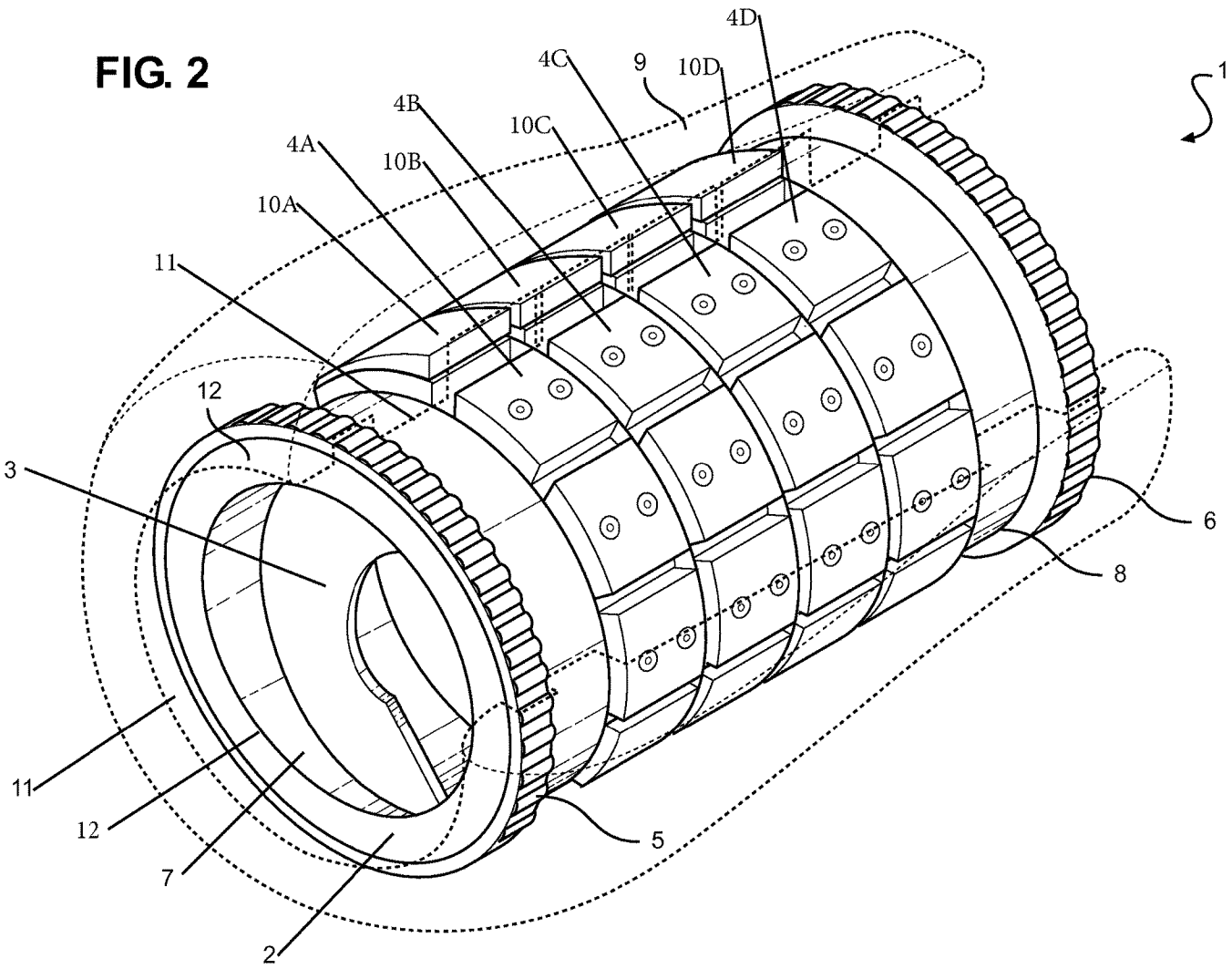
FIG. 2 is a perspective cut-away view of an embodiment of the novel marine propulsion unit having a cylinder substantially surrounded by a housing, the cylinder having a plurality of magnets located between a primary bearing member and a secondary bearing member, and at least one coil winding is connected to an inner wall of the housing.

Referring now to FIGS. 2-3 and 6, coil windings 10A-10D are connected to at least one recess 15A (FIG. 6) of inner wall 11 of housing 9. It is within the scope of this invention for inner wall 11 of housing 9 to have a plurality of recesses 15A-15D as shown in FIG. 5. FIG. 2 best shows, plurality of magnets 4A-4D are connected to outer wall 8 of cylinder 2, thereby, protruding from outer wall surface 8 of cylinder 2. FIG. 3 best illustrates plurality of magnets 4A-4D are connected to at least one recess compartment located on outer wall 8 of cylinder 2. It is within the scope of this invention for plurality of magnets 4A-4D to be connected to a plurality of compartments 18A-18D located on outer wall 8 of cylinder 2. Plurality of magnets 4A-4B are located between primary bearing member 5 and secondary bearing member 6.

As best illustrated in FIG. 3, housing 9 has recess 14A (FIGS. 3-6) which receives primary bearing member 5 and recess 14B (FIGS. 3, 5-6) which receives secondary bearing member 6. As best shown in FIG. 6, sealing member 17A is located on an end of cylinder 2 or housing 9. Sealing member 17B is located on an opposite end of cylinder 2 or housing 9. The sealing members 17A and 17B create a liquid resistant seal to prevent water (not shown) from entering between cylinder 2 and housing 9. If cylinder 2 and housing 9 are not sealed properly, water exposure can result in damage to the electrical components of marine propulsion unit 1.

FIG. 4 shows cylinder 2 having a plurality of compartments 18A-18D on outer wall 8 of cylinder 2. It is within the scope of this invention for outer wall 8 of cylinder 2 to have at least one compartment 18A. Compartments 18A retains magnet 4A. Compartments 18B retains magnet 4B. Compartments 18C retains magnet 4C. Compartments 18D retains magnet 4D. Magnets 4A-4D are set back within recess compartments 18A-18D of cylinder 2 so that magnets 4A-4D are flush with outer wall 8 of cylinder 2. Bearing member 5 is located on an end of cylinder 2 and bearing member 6 is located on an opposite end of cylinder 2.

FIG. 5 depicts coil windings 10A-10D being retained within housing 9. Bearing member 5 is connected to an end of cylinder 2. Housing 9 has recess 14A configured to receive bearing member 5 as cylinder 2 rotates. Housing 9 has recess 14B configured to receive bearing member 6 as cylinder 2 rotates. Magnet 4A is located opposite coil winding 10A. Magnet 4B is located opposite coil winding 10B. Magnet 4C is located opposite coil winding 10C. Magnet 4D is located opposite coil winding 10D. Coil winding 10B is in electrical connection 21 with ESC 19. ESC 19 is electrically connected 21 to variable electronic device 20. Electrical power supply, such as battery 22 is in electrical connection 21 with ESC 19.

Figure 7:
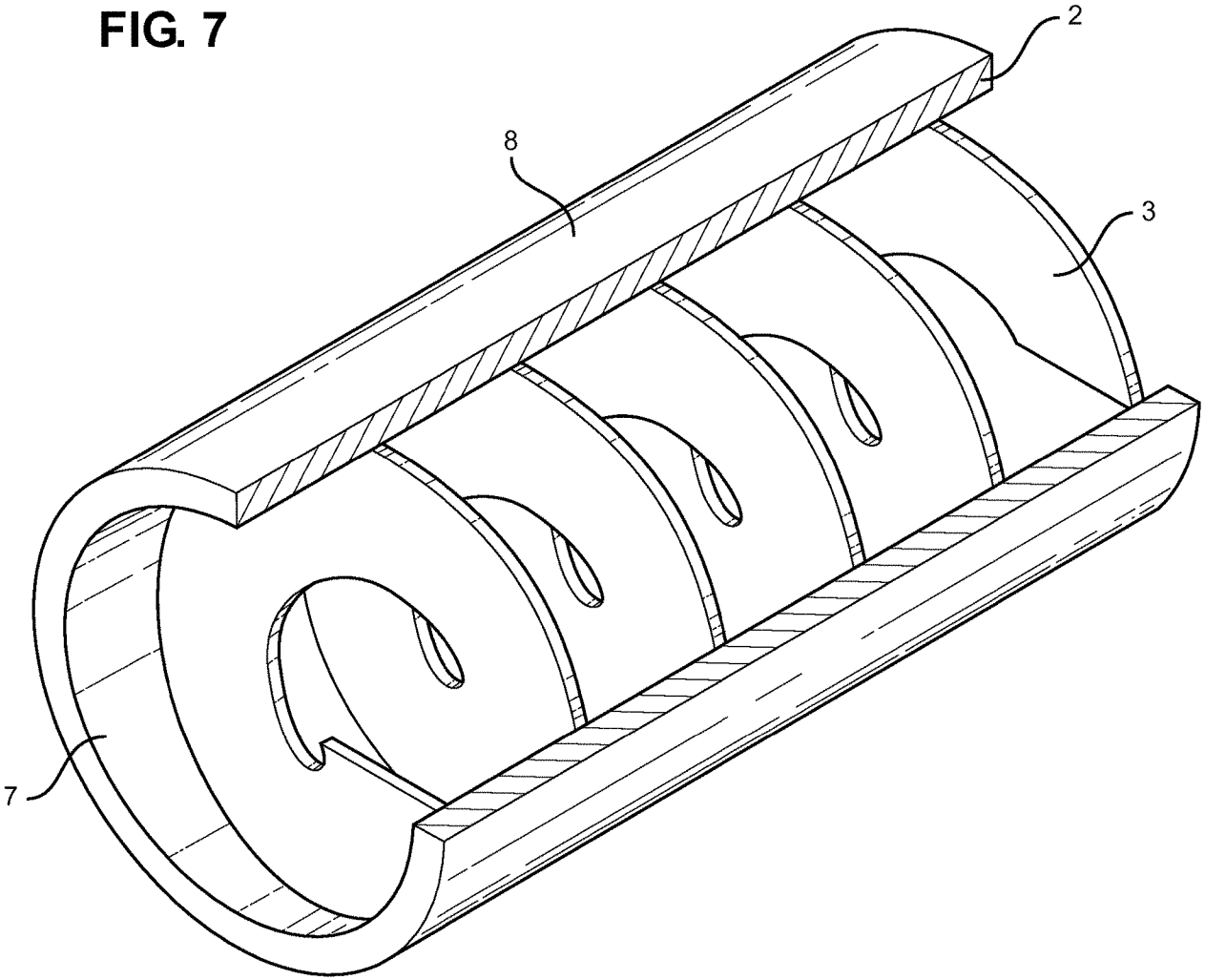
FIG. 7 is a cut-away view of the novel cylinder substantially surrounding an impeller connected to the cylinder.

FIG. 7 illustrates cylinder 2 substantially surrounding impeller 3. Impeller 3 is connected to inner wall 7 of cylinder 2. Cylinder 2 has outer wall 8.

Figure 8:
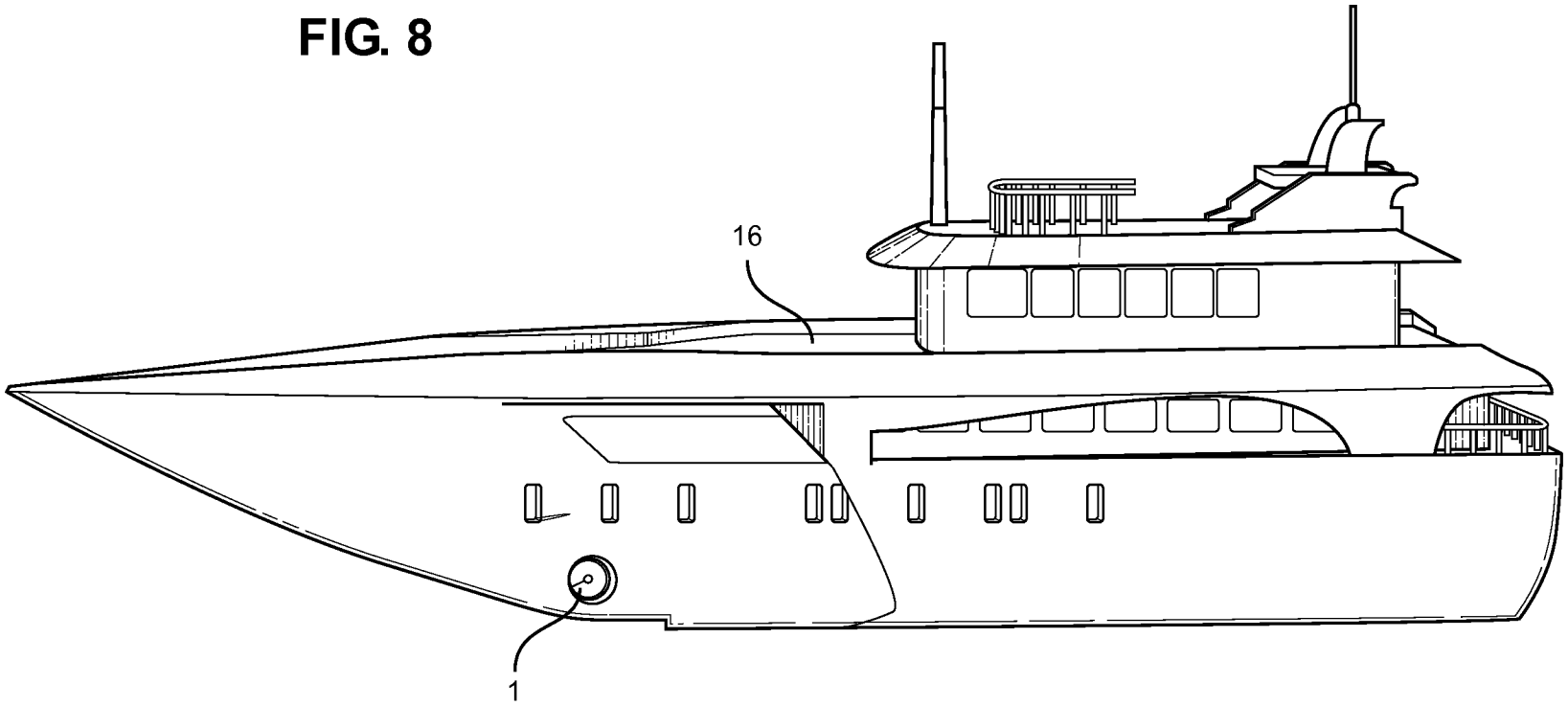
FIG. 8 is a perspective view of the novel marine propulsion unit as a bow thruster of a vessel.
Figure 9:
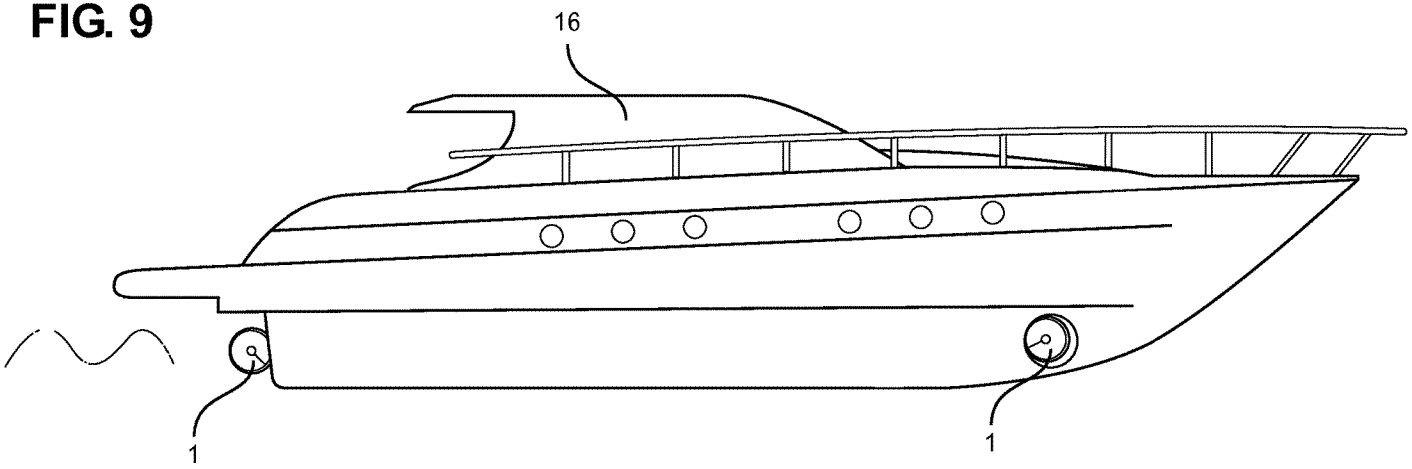
FIG. 9 is a side perspective view of the novel marine propulsion unit being a bow thruster and a stern thruster of a vessel.
Figure 10:
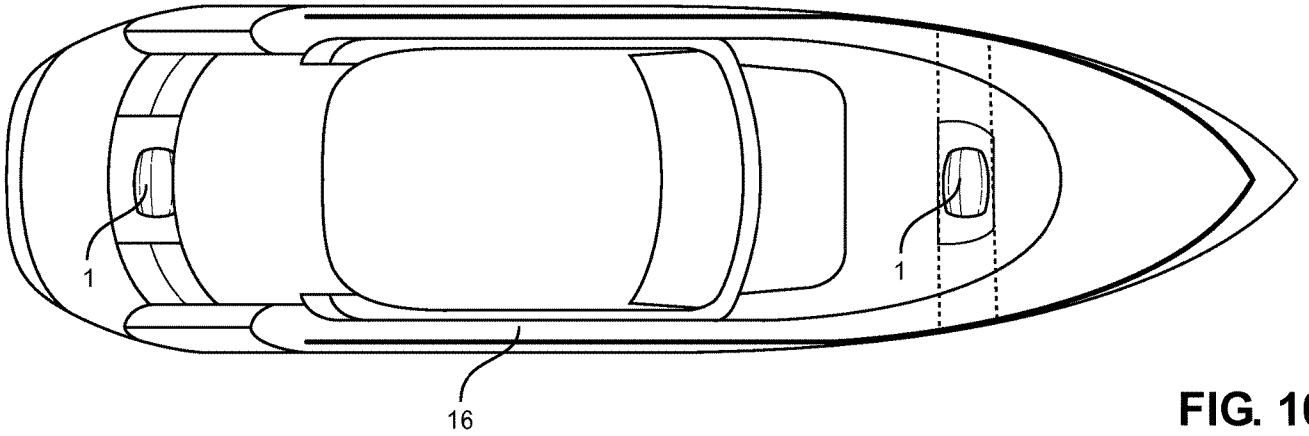
FIG. 10 is a top perspective view of the novel marine propulsion unit being a bow thruster and a stern thruster each located in a boat.
Figure 11:
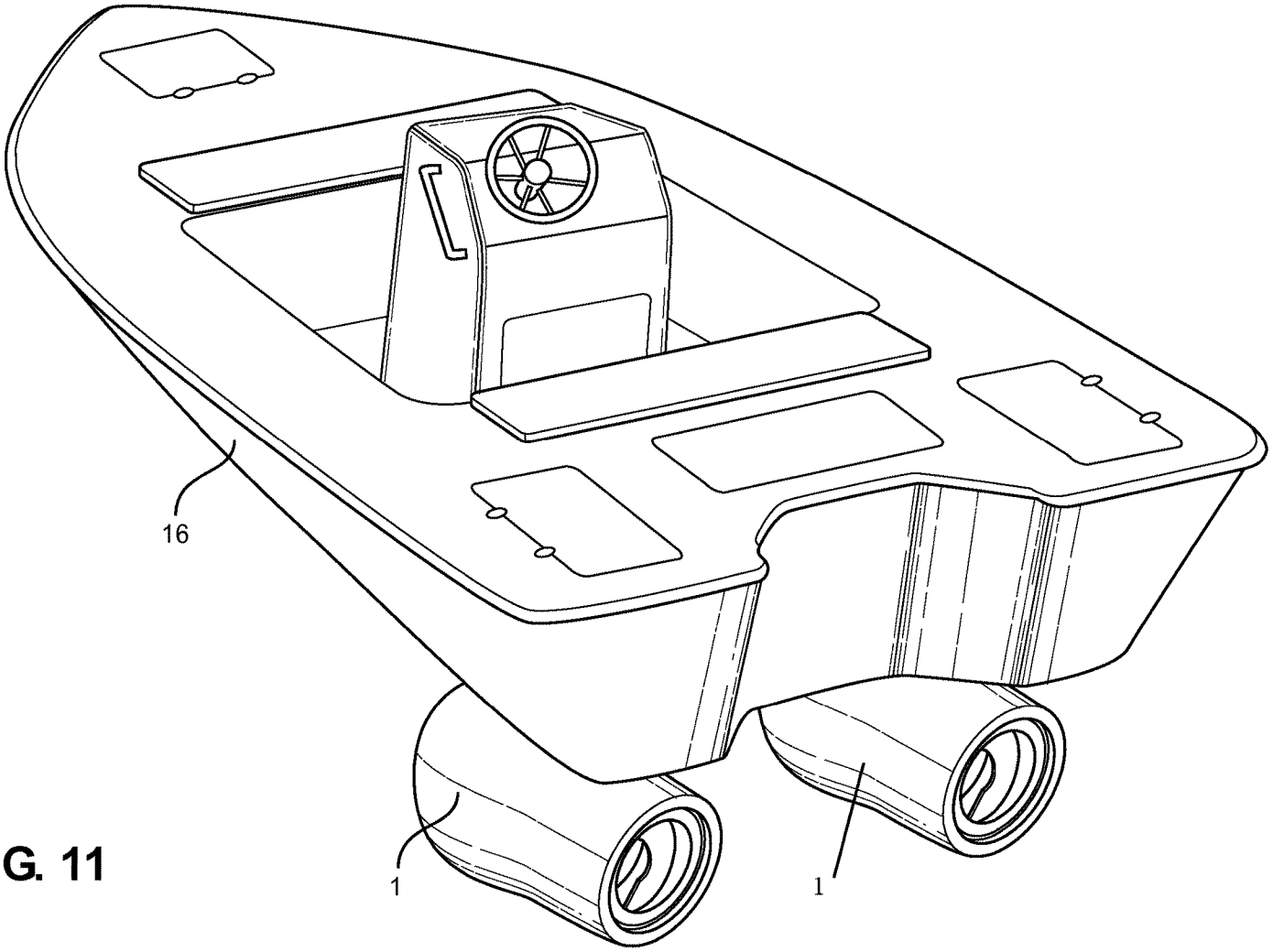
FIG. 11 is a rear perspective view of the novel marine propulsion unit connected to a vessel in place of a conventional outboard motor.
Figure 12:
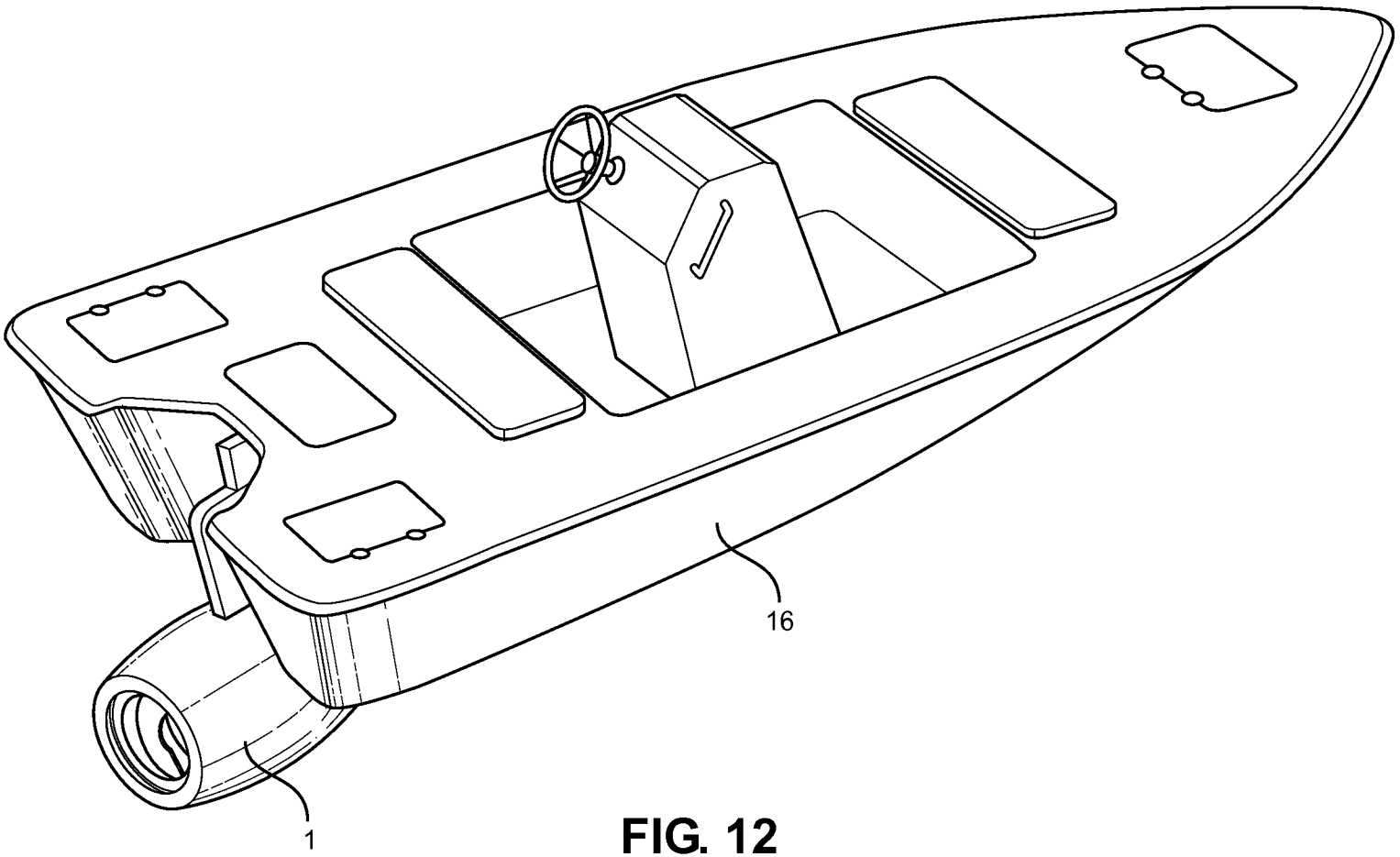
FIG. 12 is a side perspective view of the novel marine propulsion unit connected to a vessel in place of a conventional outboard motor.

FIGS. 8-10 show vessel 16 being a boat having novel marine propulsion unit 1 as a bow thruster. FIGS. 9-10 illustrate boat 16 having novel marine propulsion unit 1 as a stern thruster. FIGS. 11 and 12 illustrate boat 16 having novel marine propulsion unit 1 in place of a conventional marine outboard motor and in place of conventional screw type marine propeller. It is within the scope of this current invention for marine propulsion unit 1 to be used as an electric trolling motor for a vessel such as a fishing boat (not shown).

Figure 14:
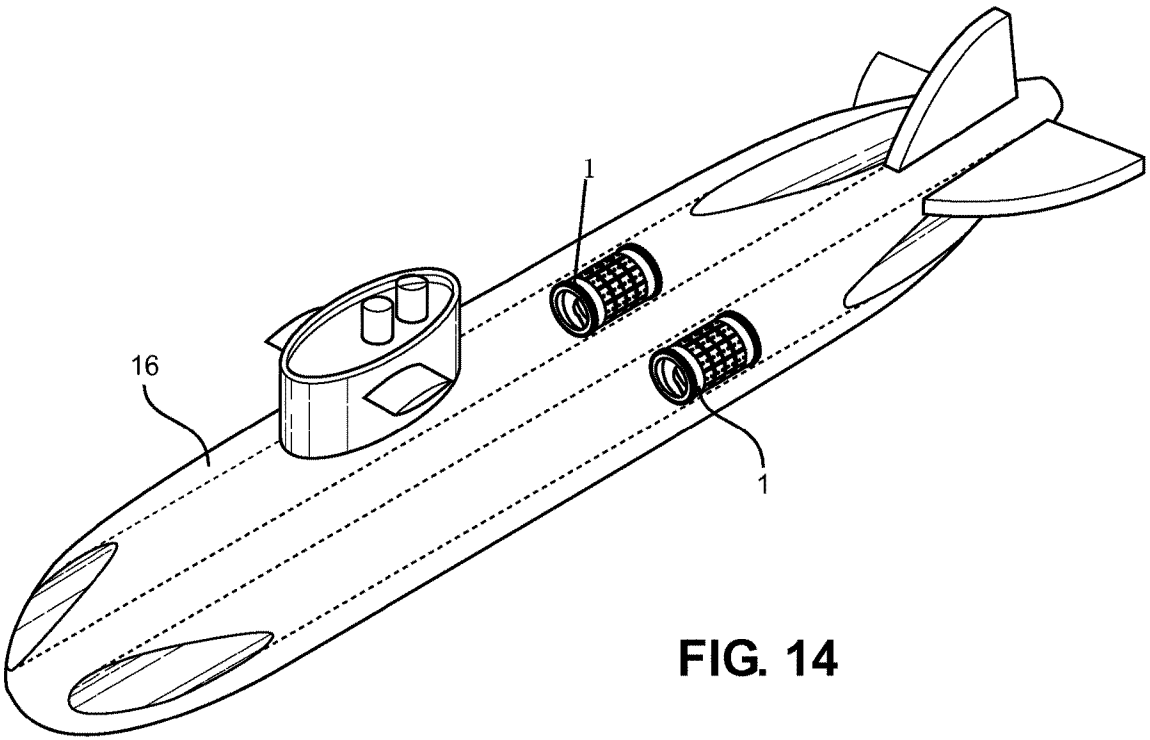
Figure 13:
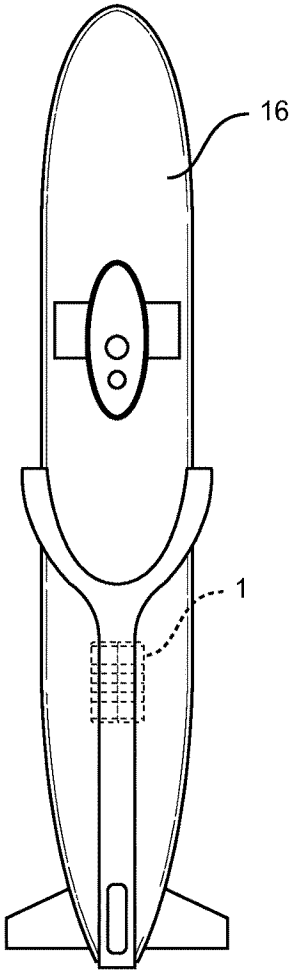
FIG. 13 is a top cut-away view of the novel marine propulsion unit connected to a submarine; and, FIG. 14 is a perspective view of the novel marine propulsion unit connected to a submarine.

FIGS. 13-14 depict novel marine propulsion unit 1 housed within submarine 16.

Construction of the Novel Marine Propulsion Unit

Referring now to FIGS. 13-14, water (not shown) is drawn in through a manifold and expels water through the stern of submarine 16. Low profile intake cowls are positioned on the sides of submarine 16. Water is drawn into the marine propulsion unit intake. Accelerated exhaust water is then ducted to the stern of the submarine where it exits as thrust and produces forward propulsion. When the polarity to the coil windings is reversed, the cylinder of novel marine propulsion unit 1 rotates in reverse, resulting in water being drawn into the stern nozzle and expelling the accelerated water through the intake cowls. This method provides reverse thrust for slowing, stopping, or maneuvering. Electrical power can be supplied by the onboard electrical generation capabilities of the vessel, such as a submarine or by a battery.

Figure 1:
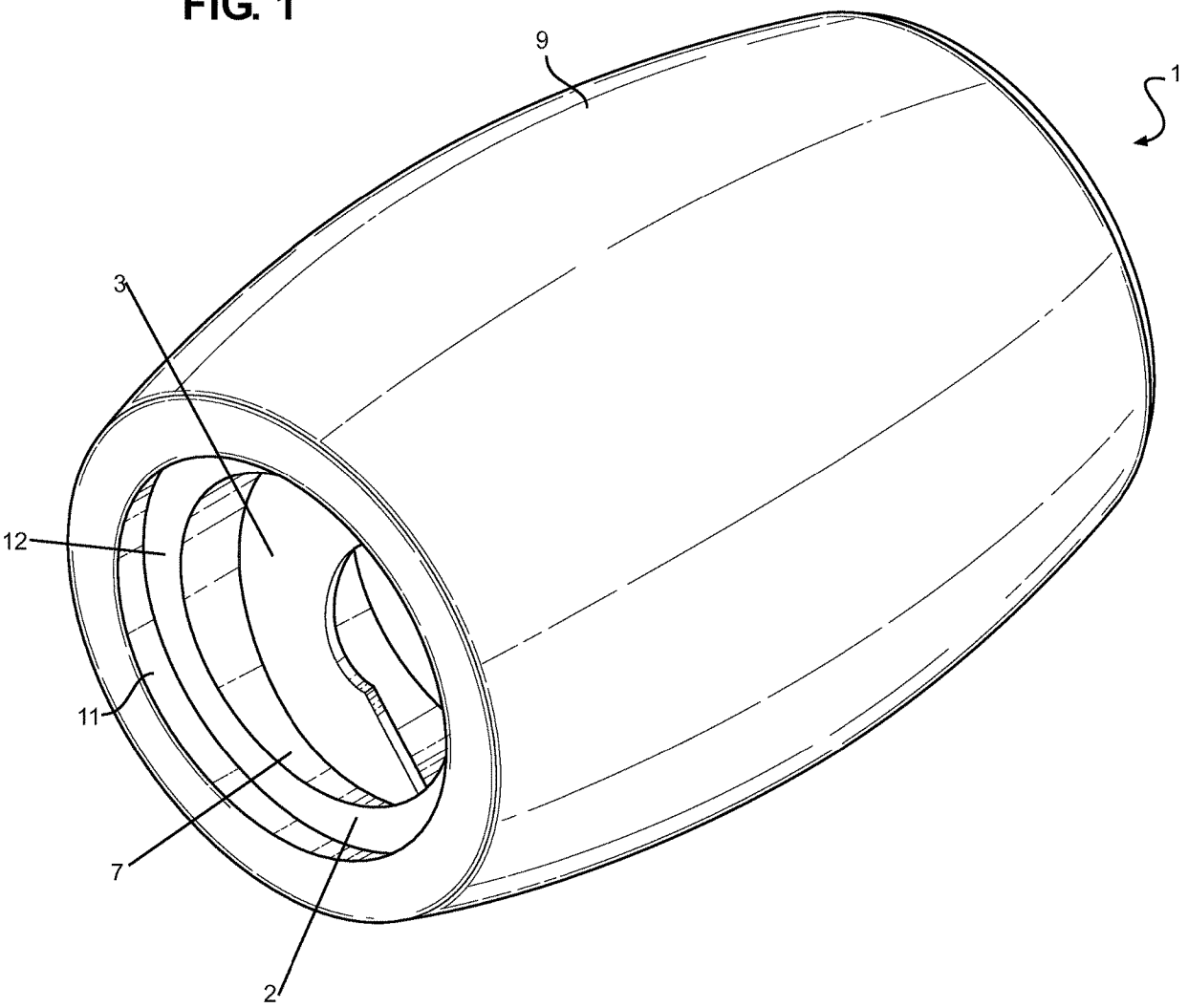
FIG. 1 is a perspective view of the novel marine propulsion unit having a cylinder substantially surrounded by a housing.

Referring now to FIG. 1, in a preferred embodiment, housing 9 can have a narrow inlet and outlet, bulging out towards the centerline to contain the coil windings. FIG. 2 shows housing 9 internally retaining four rings of coil windings 10A-10D that will line up with permanent magnets 4A-4D on the auger cylinder 2. Cylinder 2 is suspended within housing 9 with roller bearings 5 and 6. Roller bearings 5 and 6 are contained within inner wall 11 of housing 9. Recesses 14A and 14B of housing 9 allow minimal clearance for the rotating permanent magnets 4A-4D that are attached to outer wall 8 of cylinder 2.

Referring now to FIG. 2, marine propulsion unit 1 is a brushless DC motor. A screw-type impeller 3 center auger is fixedly mounted in cylinder 2. Cylinder 2 is connected to permanent magnets 4A-4D. Cylinder 2 rotates within hydrodynamic housing 9 that is embedded with energized coil windings 10A-10D. As electricity alternately energizes the coil windings 10A-10D and creates magnetic fields, opposing electromagnetic poles cause impeller 3 to spin. Water is forcefully drawn at one end of vessel 16 and is ejected at the opposite end of vessel 16, thereby, creating thrust.

Referring now to FIG. 5, the wires in electrical connection to each coil winding 10A-10D set will electrically connect 21 to electronic speed control 19, which will then electrically connect to a joystick controller 20 at the boat helm to digitally and proportionally control the forward, neutral, and reverse orientation. DC power can be supplied by battery bank 22 that replaces a boat's traditional gas or diesel tank.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall there between.

Now that the invention has been described,

The invention claimed is:

1. A marine propulsion unit, comprising:

a cylinder, said cylinder substantially surrounding an impeller, said impeller connected to said cylinder;

said cylinder having a first end located opposite a second end, said cylinder having a first bearing member and a first sealing member located on said first end of said cylinder, said cylinder having a second bearing member and a second sealing member located on said second end of said cylinder;

said cylinder having a plurality of magnets connected to said cylinder, said plurality of magnets are located between said first bearing member and said second bearing member; and, said cylinder is substantially surrounded by a housing, said housing connected to at least one coil winding, said housing has a reduced diameter inlet and outlet, bulging out towards a centerline to contain said at least one coil winding, said at least one coil winding is associated with an electrical power source, whereby, the combination of said at least one coil winding and said plurality of magnets form a motor causing said cylinder to rotate within said housing when said electrical power source is applied to said at least one coil winding, said at least one coil winding is electrically connected with an electronic speed control, said electronic speed control receives commands from a switch.

2. A method of driving an impeller of a marine propulsion unit system, comprising the steps of:

providing a vessel;

providing said marine propulsion unit connected to said vessel, said marine propulsion unit comprising, a cylinder, said cylinder substantially surrounding an impeller, said impeller connected to said cylinder, said cylinder having a first end located opposite a second end, said cylinder having a first bearing member and a first sealing member located on said first end of said cylinder, said cylinder having a second bearing member and a second sealing member located on said second end of said cylinder, said cylinder having a plurality of magnets connected to said cylinder, said plurality of magnets are located between said first bearing member and said second bearing member, and said cylinder is substantially surrounded by a housing, said housing connected to at least one coil winding, said housing has a reduced diameter inlet and outlet, bulging out towards a centerline to contain said at least one coil winding;

providing an electrical power source associated with said at least one coil winding, whereby, the combination of said at least one coil winding and said plurality of magnets form a motor causing said cylinder to rotate within said housing when said electrical power source is applied to said at least one coil winding;

providing an electronic speed control, said electronic speed control is electrically connected with said at least one coil winding, said electronic speed control receiving commands from a switch;

producing thrust in first direction when a liquid is drawn into said first end of said cylinder, whereby, orienting said vessel in a first orientation; and, producing thrust in a second direction when said liquid is draw into said second end of said cylinder, whereby, orienting said vessel in a second orientation.

* * * * *